United States Patent [19]

Langhorst

[11] 4,180,341

[45] Dec. 25, 1979

[54] HINGED BINDER ASSEMBLY FOR SAMPLE CARDS

[76] Inventor: Carsten Langhorst, Einstmannstr. 33, 2804 Lilienthal, Fed. Rep. of Germany

[21] Appl. No.: 891,248

[22] Filed: Mar. 29, 1978

[30] Foreign Application Priority Data

| | | | |
|---|---|---|---|
| Mar. 29, 1977 | [DE] | Fed. Rep. of Germany | 2713736 |
| Sep. 28, 1977 | [DE] | Fed. Rep. of Germany | 2743558 |
| Oct. 26, 1977 | [DE] | Fed. Rep. of Germany | 2747931 |

[51] Int. Cl.[2] ..... G09F 5/00

[52] U.S. Cl. ..... 402/80 R; 40/530; 281/45

[58] Field of Search ..... 40/376, 389, 388, 526, 40/527, 530; 402/80 R, 70, 75, 76, 502; 281/45

[56] References Cited

U.S. PATENT DOCUMENTS

| | | | |
|---|---|---|---|
| 316,586 | 4/1885 | Verbeck | 40/530 |
| 966,448 | 8/1910 | Jacobs | 40/530 X |
| 3,353,844 | 11/1967 | Staats | 402/70 |
| 3,793,758 | 2/1974 | Feldhusen et al. | 40/530 |

FOREIGN PATENT DOCUMENTS

| | | | |
|---|---|---|---|
| 359665 | 4/1906 | France | 40/530 |

*Primary Examiner*—Robert L. Spicer, Jr.

*Attorney, Agent, or Firm*—Sughrue, Rothwell, Mion, Zinn and Macpeak

[57] ABSTRACT

A hinged binder assembly for a plurality of stacked planar plates or cards 11 on which rug samples 10 are mounted. Each card is laterally inserted and held at one end in a generally rectangular rail member 12, 27 having circular passages 23, 24; 33, 34 in respective rear and front walls thereof. U-shaped stirrups 19, 29 are inserted into and hingedly connect the rail members together from both sides such that one arm of each stirrup extends into a rear wall passage of one rail member while its opposite arm extends into a front wall passage of the rail member lying immediately above in the binder "closed" position. The connecting webs 20, 30 of each stirrup thus extend at an inclined angle between adjacent rail members. With this arrangement the sample bearing cards can be turned over one at a time in the manner of book pages, or pulled out in a translational manner into a partially overlapping stepped configuration wherein portions of all samples are exposed for viewing.

9 Claims, 10 Drawing Figures

HINGED BINDER ASSEMBLY FOR SAMPLE CARDS

BACKGROUND OF THE INVENTION

The invention relates to a pattern book having a number of pivoted-together retaining rails on which elements in sheet or panel form, such as rug samples, can be mounted.

The invention is mainly concerned with pattern books embodied by a number of retaining rails combined to form a unit. Individual pattern cards made of stiff board are mounted in the rails. The pattern cards carry individual large-surface-area patterns, more particularly of textile floor coverings. The rails, which are usually extruded section members, are so interconnected that the pattern cards can be turned over like the pages of a book.

In a known pattern book of the kind described, the retaining rails have hinge portions on the side near the "spine" of the book. A continuous thin rod is introduced into the hinge portions so that adjacent rails can pivot relatively to one another like the parts of a hinge. Also, the pattern cards can be turned over individually like the pages of a book.

SUMMARY OF THE INVENTION

It is an object of the invention so to improve a device, more particularly a pattern book, of the kind described that the patterns can be presented in different ways.

According to the invention, therefore, the retaining rails can be moved relatively to one another by translation into a position in which the pattern cards are in a stepped arrangement.

In other words, the underlying idea of the invention is so to interconnect the retaining rails that the pattern cards can take up additional positions relatively to one another. Not only can the rails be turned over individually like the pages of a book but also the pattern cards can be brought into a stepped or overlapping relationship to one another by an appropriate displacement of the retaining rails. With the cards in this overlapping position, the user of the book can see the whole collection of patterns although the book is in other respects closed, since at least edge regions of the patterns of all the cards contained in the book are exposed for viewing.

According to the invention, the retaining rails are so interconnected by stirrup-like members, more particularly U-shaped stirrup-like members that two such members interconnect any two adjacent rails which, with the book closed, are disposed one above another. The arms of the stirrup-like members are introduced into laterally open recesses or closed passages in the retaining rails. The U-members used to interconnect the retaining rails of devices in which such rails are required both to pivot and to be transversely displaceable extend diagonally from a passage on the back of the rail to a passage at the front of the adjacent rail. The webs of the U-members therefore extend inclinedly. If the pattern cards are required merely to be pivotable after the fashion of the pages of a book and not to be displaceable, passages or the like are provided at the back of the rails, a passage being provided at each back corner. In this event a correspondingly smaller U-member extends between directly adjacent—i.e., facing—passages of rails disposed one above another.

BRIEF DESCRIPTION OF THE DRAWINGS

Other details and features of the invention will be described hereinafter with reference to embodiments shown in the drawings wherein.

DETAILED DESCRIPTION OF THE PREFERRED EMBODIMENTS

Figure 1:
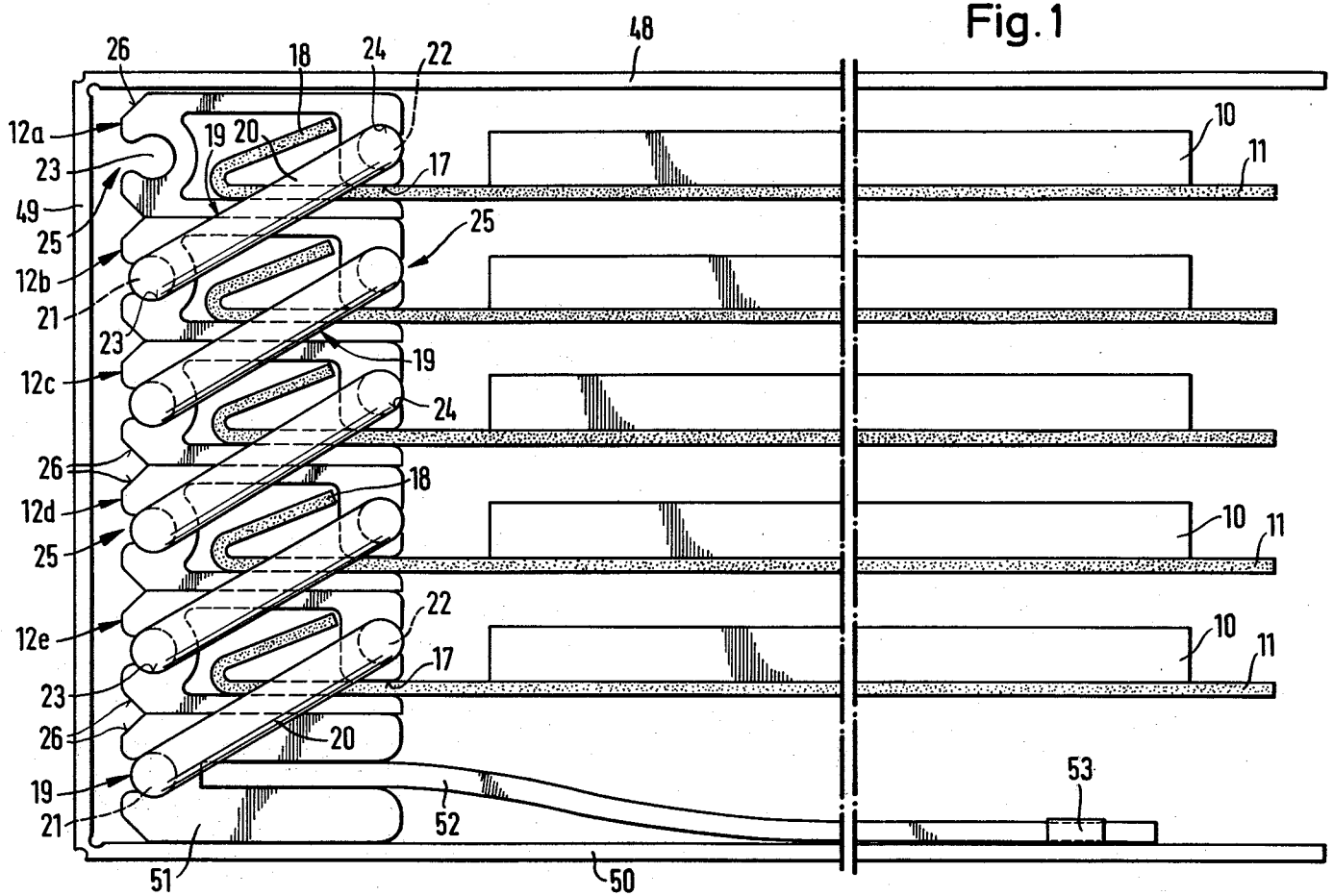
FIG. 1 is a diagrammatic view in side elevation of a closed pattern book of a first embodiment.

The pattern book according to this invention is of use more particularly for textile patterns 10, more particularly of floor coverings. The various patterns are placed on pattern cards 11 made of an appropriate material, more particularly board, it being possible for more than one pattern to be placed on a single card. A number of cards 11 containing patterns 10 are combined to form a book.

Accordingly, one edge of each card 11 engages in a respective retaining rail 12*a*, 12*b*, 12*c* and so on. Conveniently, the rails, which are hollow section members, are extruded plastics articles. In the present case the rails have a substantially rectangular cross-section comprising a top wall 13, a bottom wall 14, an end wall 15 and a rear wall 16. In the embodiment shown in FIGS. 1 to 3, the end wall 15 co-operates with the top wall 13 to bound a slot 17 through which the pattern card 11 can enter the space inside the retaining rail. In the embodiment shown the cards 11 are retained in their respective retaining rails by means of a bent-over edge strip 18.

The retaining rails 12*a*, 12*b*, 12*c* and so on are so interconnected for movement that with the pattern book closed as shown in FIG. 1, the various rails are disposed one above another like a block and thus form something like the spine of a book, the cards 11 resembling the pages of the book.

Figure 2:
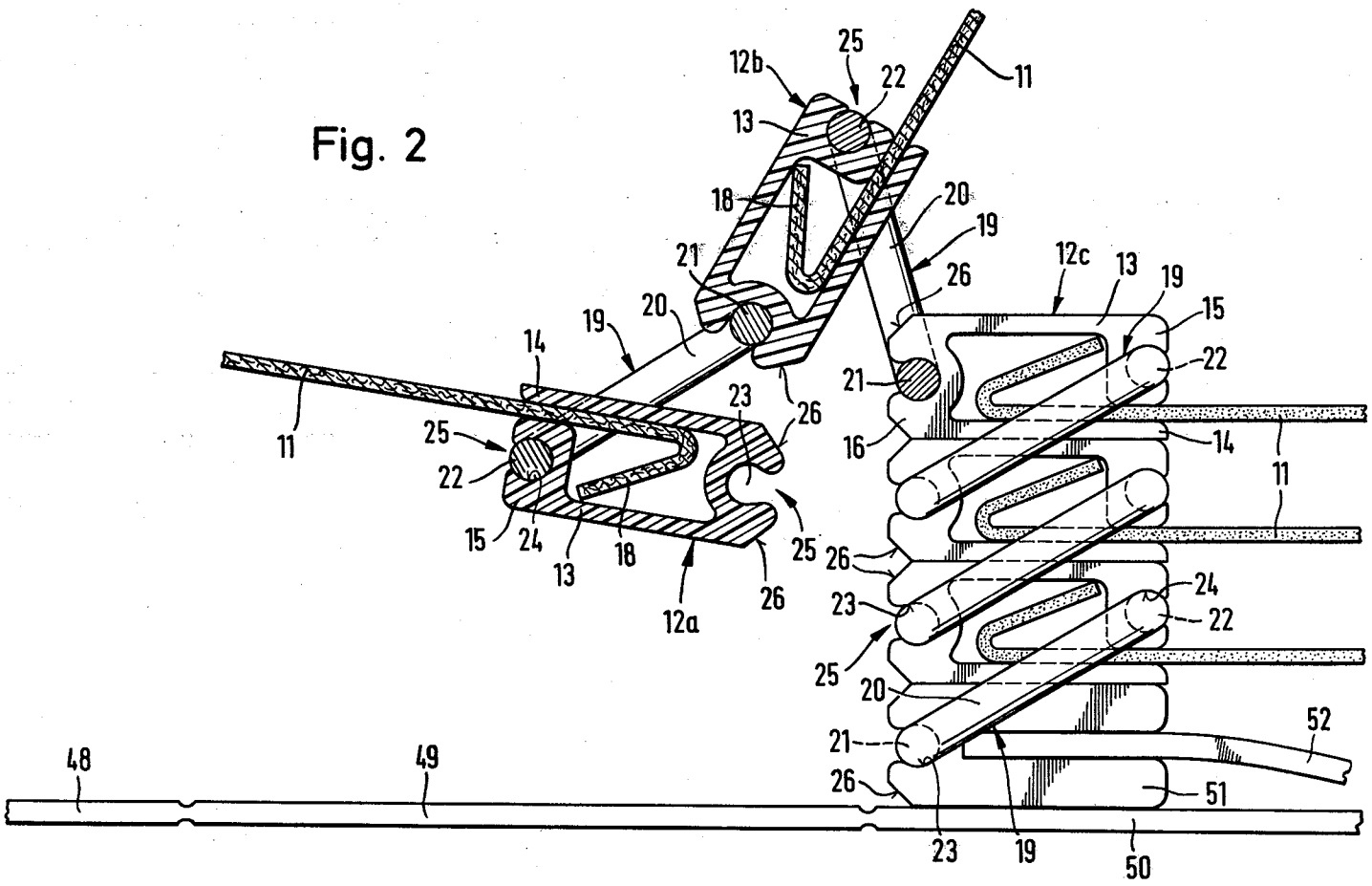
FIG. 2 is a partly sectioned view showing a part of the pattern book of FIG. 1 with some of the pattern cards being shown in various positions as they are turned over like the pages of a book.

The rails and therefore the cards 11 can be so moved relatively to one another purely in translation that the cards 11 come into a part-overlapping or stepped relationship to one another. This part-overlapping position can be seen in FIG. 5 in connection with another embodiment of the invention. As a result of this displacement, the cards 11—i.e., their patterns 10—are at least partly visible one beside another at their ends remote from the retaining rails. Consequently, in this stepped or part-overlapping position all the patterns 10 of the collection can be presented for simultaneous viewing in immediately adjacent relationship. Alternatively, and as shown in FIG. 2, the rails and the cards 11 can be turned over like the pages of a book—i.e., they can pivot through approximately 180° relatively to one another.

Figure 3:
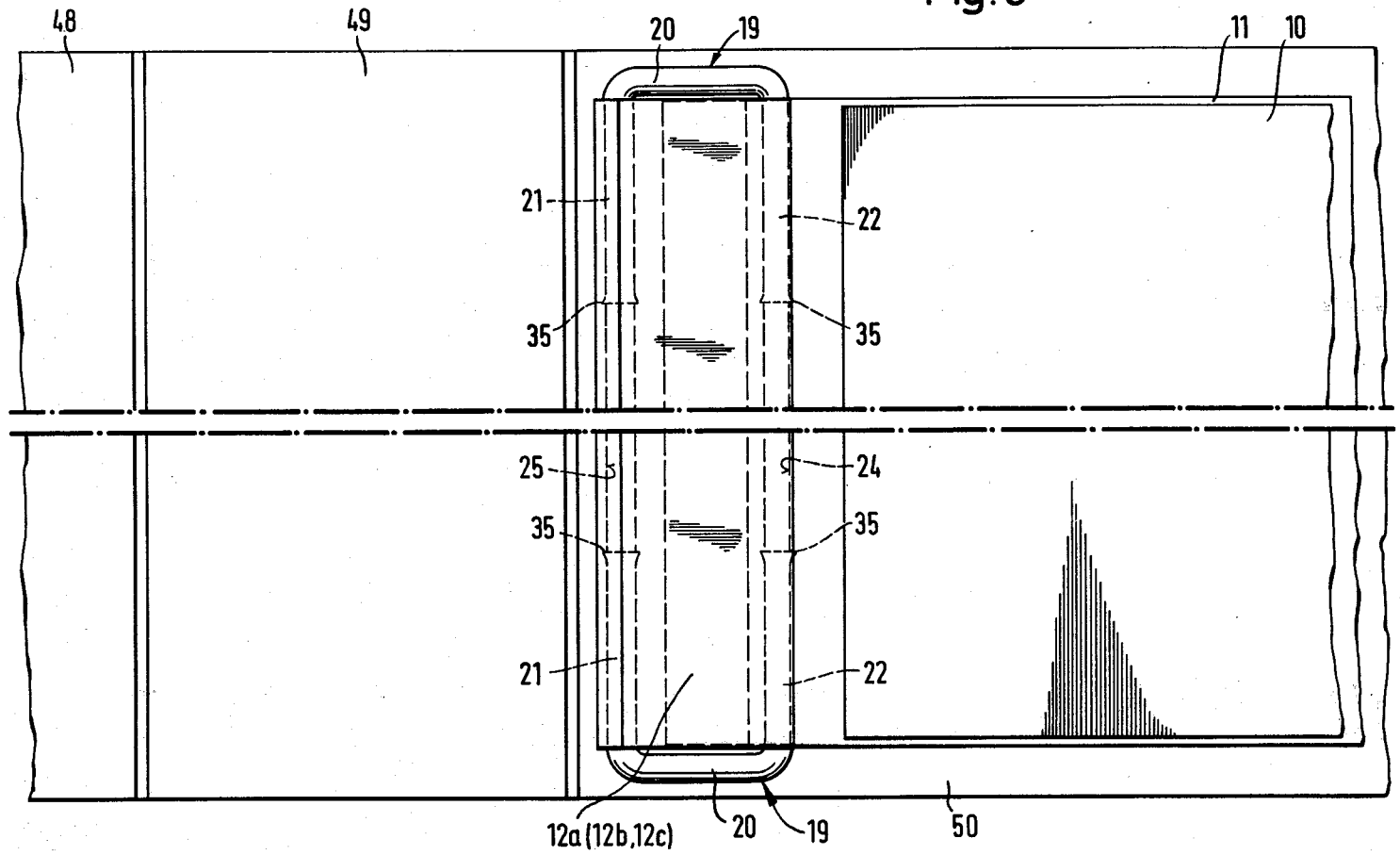
FIG. 3 is a plan view of a part of the pattern book of FIGS. 1 and 2 with the top cover of the book open.
Figure 4:
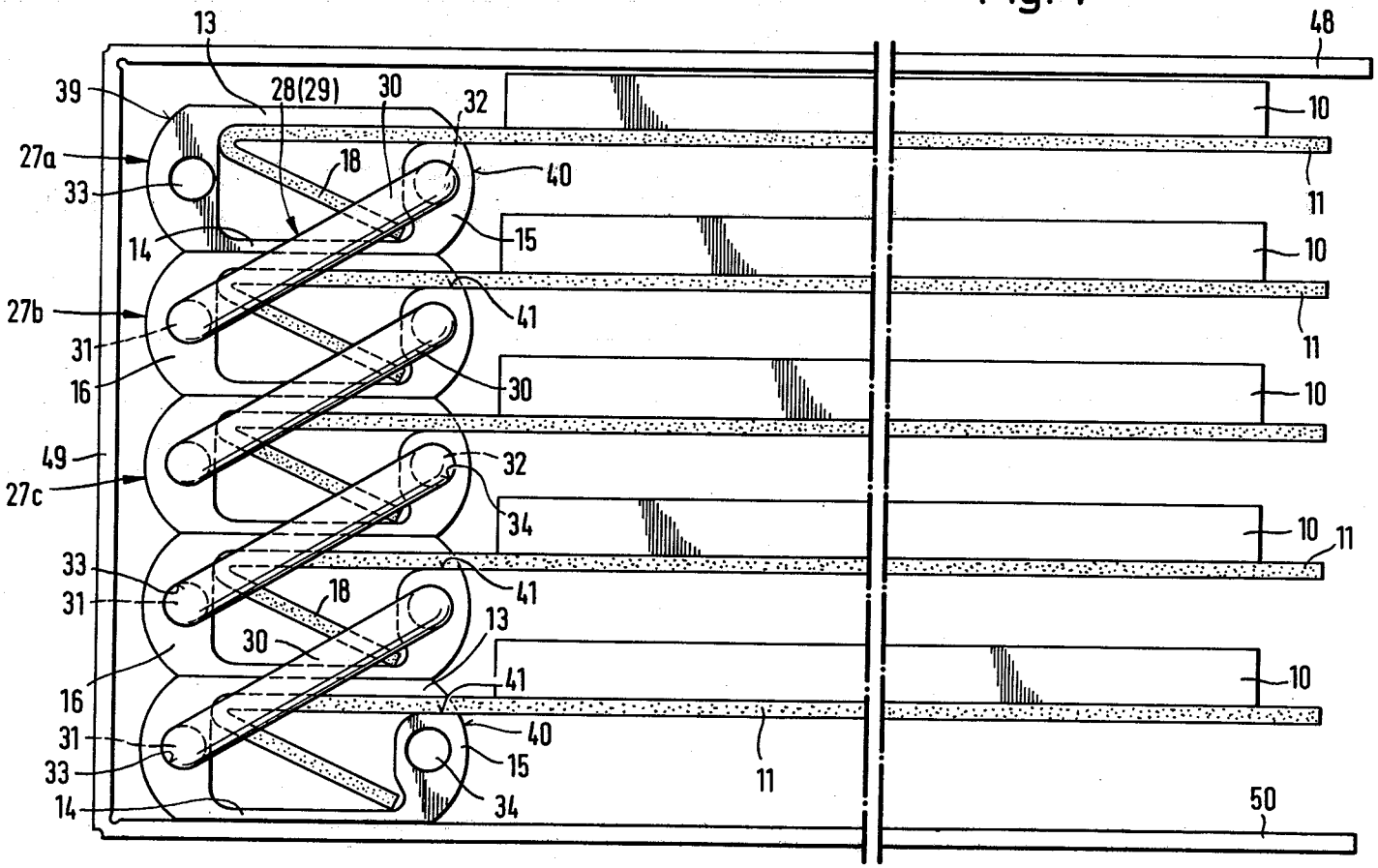
FIG. 4 is a diagrammatic view in side elevation, similar to FIG. 1, of another embodiment of a pattern book.

So that they may make these different movements, the retaining rails 12*a*, 12*b*, 12*c* are interconnected by special connecting members. They can take the form of a closed rectangular (wire) stirrup-like member. Preferably, however, and as shown in FIG. 3, U-shaped stirrup-like members 19 are inserted in the end regions of the rails to be interconnected. Members 19 form webs 20 and arms 21, 22. A single member 19 so interconnects any two adjacent retaining rails that the connecting element engages the upper rail in its end face region near the pattern card 11 and the lower rail at the back.

By means of their arms 21, 22 the members 19 are mounted for rotation in recesses 23, 24 which extend lengthwise of the retaining rails near the correspondingly thickened end wall 15 and rear wall 16. In the embodiment shown in FIGS. 1 to 3, the recesses 23, 24 merge into outwards facing slots 25 through which the arms 21, 22 are pressed at assembly of the rails 12*a*, 12*b*, transversely thereto. The webs 20 which are disposed outside before the ends of the rail therefore extend inclinedly from the recess 23 in any rail to the recess 24 of the rail immediately above.

Figure 5:
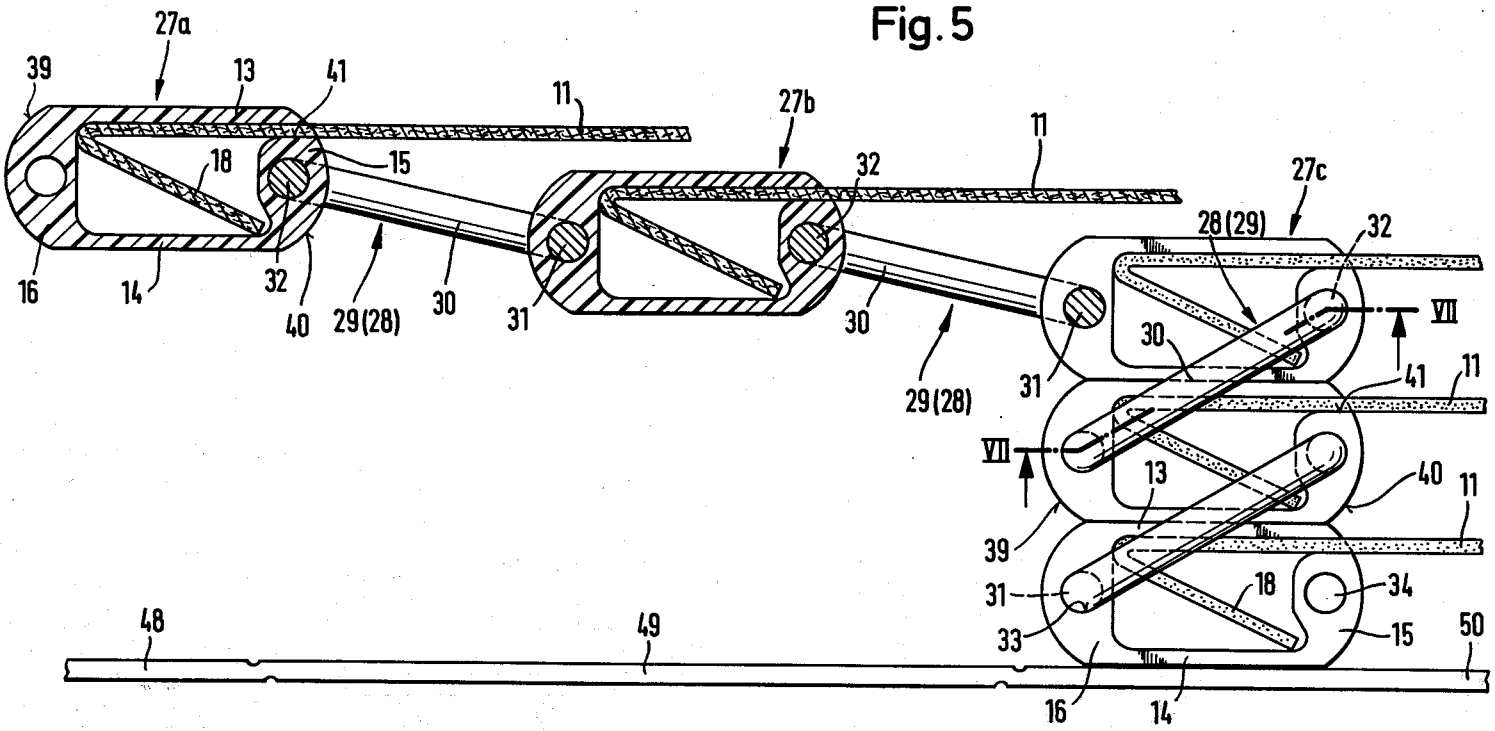
FIG. 5 is a partly sectioned view of the book of FIG. 4 with some of the pattern cards disposed in a part-overlapping relationship to one another.
Figure 6:
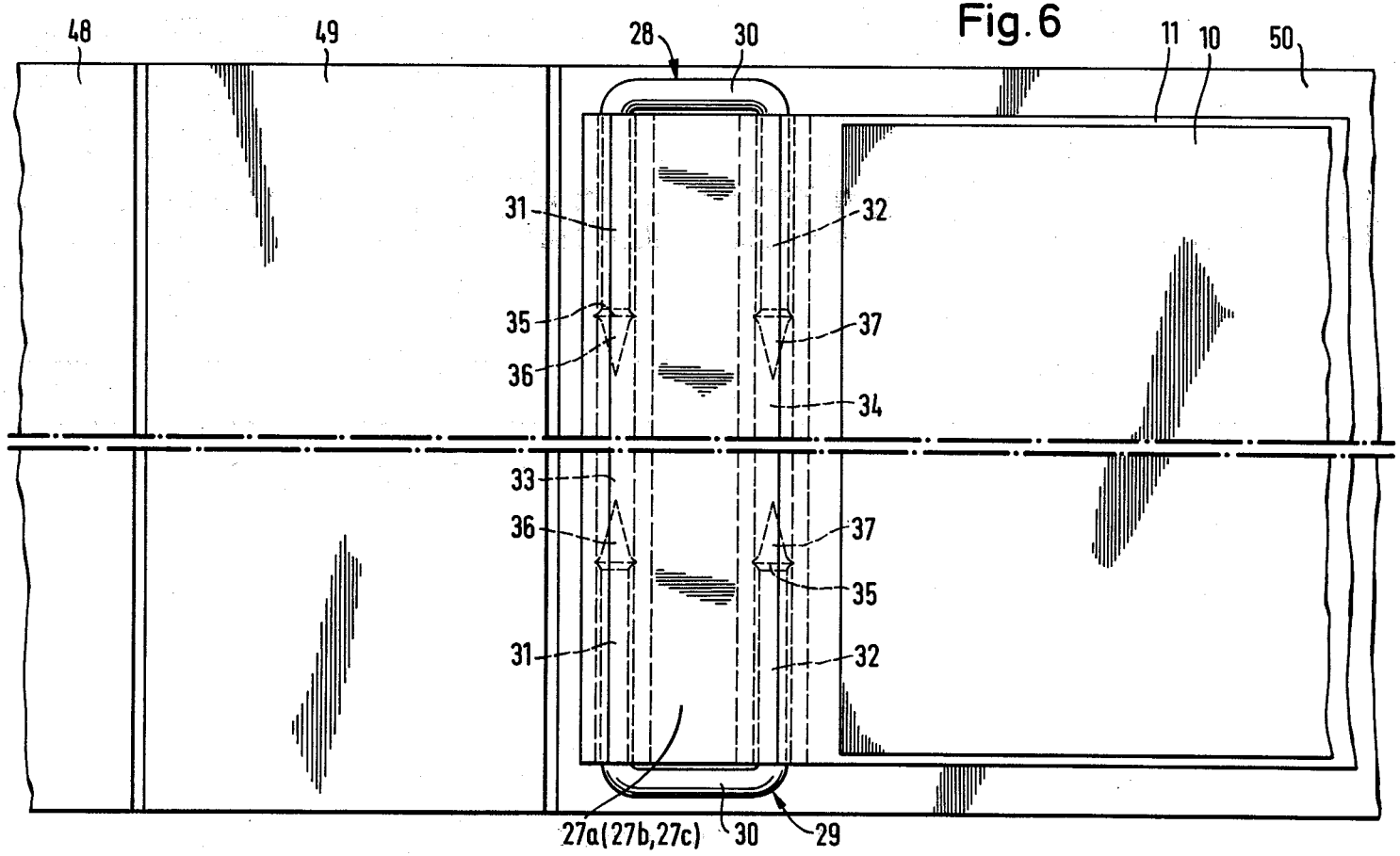
FIG. 6 is a plan view of a part of the book shown in FIGS. 4 and 5.
Figure 7:
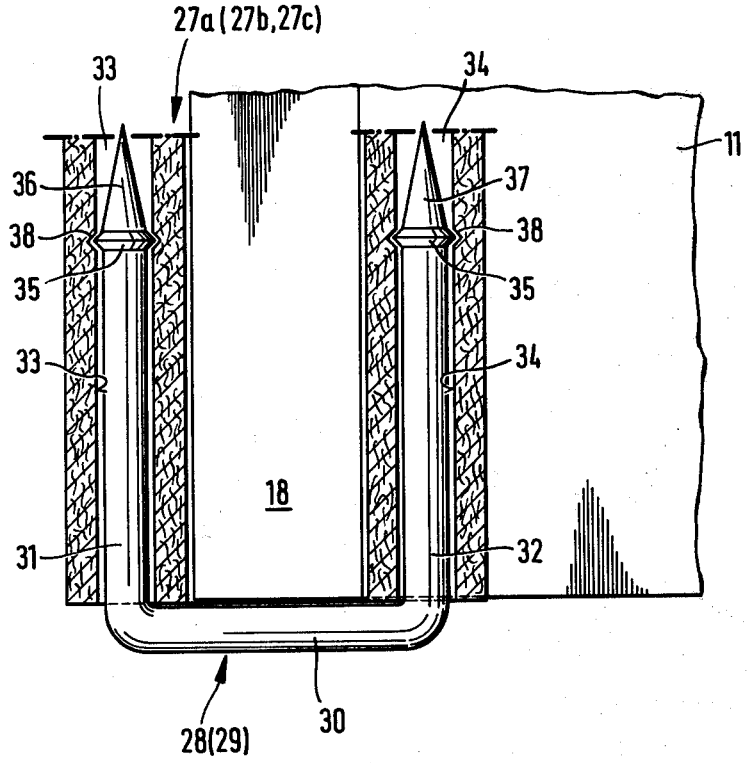
FIG. 7 is a detail section on the line VII—VII of FIG. 5 to an enlarged scale.

When the rails with the cards 11 move from the "closed-book" position of FIG. 1 into the part-overlapping or stepped position, the retaining rails are moved transversely relatively to one another in the manner shown in FIG. 5, the particular member 19 concerned pivoting around the longitudinal central axis of the associated bottom arm 21; the (top) arm 22 also rotates around its axis while the webs 20 pivot e.g. through an angle less than 180°. The rails follow the latter movement but do not rotate around their own longitudinal axis. In the solid-line position the rails 12*a*, 12*b* and so on are offset from one another substantially by the length of the webs 20 including the width of the rails 12*a*, 12*b* and so on.

When a user leafs through the cards 11 like the pages of a book, the rails make a composite movement in which they shift laterally and also rotate around their own axis; the resulting intermediate positions are shown in FIG. 2. So that the rails do not get strained nor jammed while being turned over, they have on the back—i.e., near the rear wall 16—a narrowing cross-section—i.e., a cross-section having marked bevels 26. So far as the other components of the movement are concerned, the retaining rail with the associated member 19 is pivoted around the axis of the arm 21 with substantially no appreciable alteration in the relative position of the member 19 to the particular rail which has moved.

Recesses 23, 24 protect members 19 from undesirable axial motion. For this purpose the blunt ends of arms 21, 22 have a sharp-edged collar 35 produced e.g. by upsetting. As a result of motion of arms 21, 22 relative to rails 12*a*, 12*b*, collar 35 forms a groove and engages in the rail material, thus securing the rails.

In the pattern book embodiment shown in FIGS. 4 to 7 the rails 27*a*, 27*b*, 27*c* are interconnected by members 28, 29, whereby the movements of the cards 11 are similar to the example previously described. Each member 28, 29 comprises a web 30, which extends inclinedly or transversely before the ends of the rails and which merges into arms 31, 32. The same engage from the ends of the rails in recesses or the like which are in the form of closed circular passages 33, 34. The arms 31, 32 are engaged axially in the passages 33, 34, possibly with resilient deformation of the material of the rails. Also, the arms 31, 32 are rotatable in the passages 33, 34.

The arms 31, 32 are secured against axial displacement in the passages 33, 34 by having thickened parts which in the present case take the form of a peripheral projecting sharp-edged collar 35. The uniformly cylindrical arm 31 or 32 merges by way of its collar 35 into a pointed end 36 or 37. The collar 35 is barb-like—i.e., in the part near the end 36 or 37 it has a rubbing surface rising in accordance with the flank inclination. This feature facilitates introduction of the arms 31, 32 into the passages 33, 34 but prevents the arms from being pulled out of the passages, because the collar 35 catches.

The size and design of the collar 35 relative to the diameter of the passages 33, 34 is such that, with the collar in its end position, rotation of the arms 31, 32 relative to the rails causes the sharp-edged collar 35 to bite into the passage walls so that a peripheral transverse groove 38 arises and helps to secure the arms 31, 32 positively.

A special feature of the retaining rails 27*a*, 27*b*, 27*c* and so on of this embodiment is that the rear and front outside surfaces 39, 40 of the walls 15, 16 are in the form of an arc, more particularly a circle arc. The resulting surfaces are smooth all the way round and make for ease of movement as the retaining rails move relatively to one another in the various positions.

Another special feature is a top slot 41 for the card 11 in the top cross-section of the retaining rails, the slot 41 being disposed between the top wall 13 and the end wall 15. The cards 11 can therefore have the bent-round edge strip 18 introduced into the rails by movement lengthwise thereof from the rail ends, as indicated in solid lines in FIG. 5. The members 28, 29 do not therefore cause difficulties when the cards 11 are being assembled.

Figure 8:
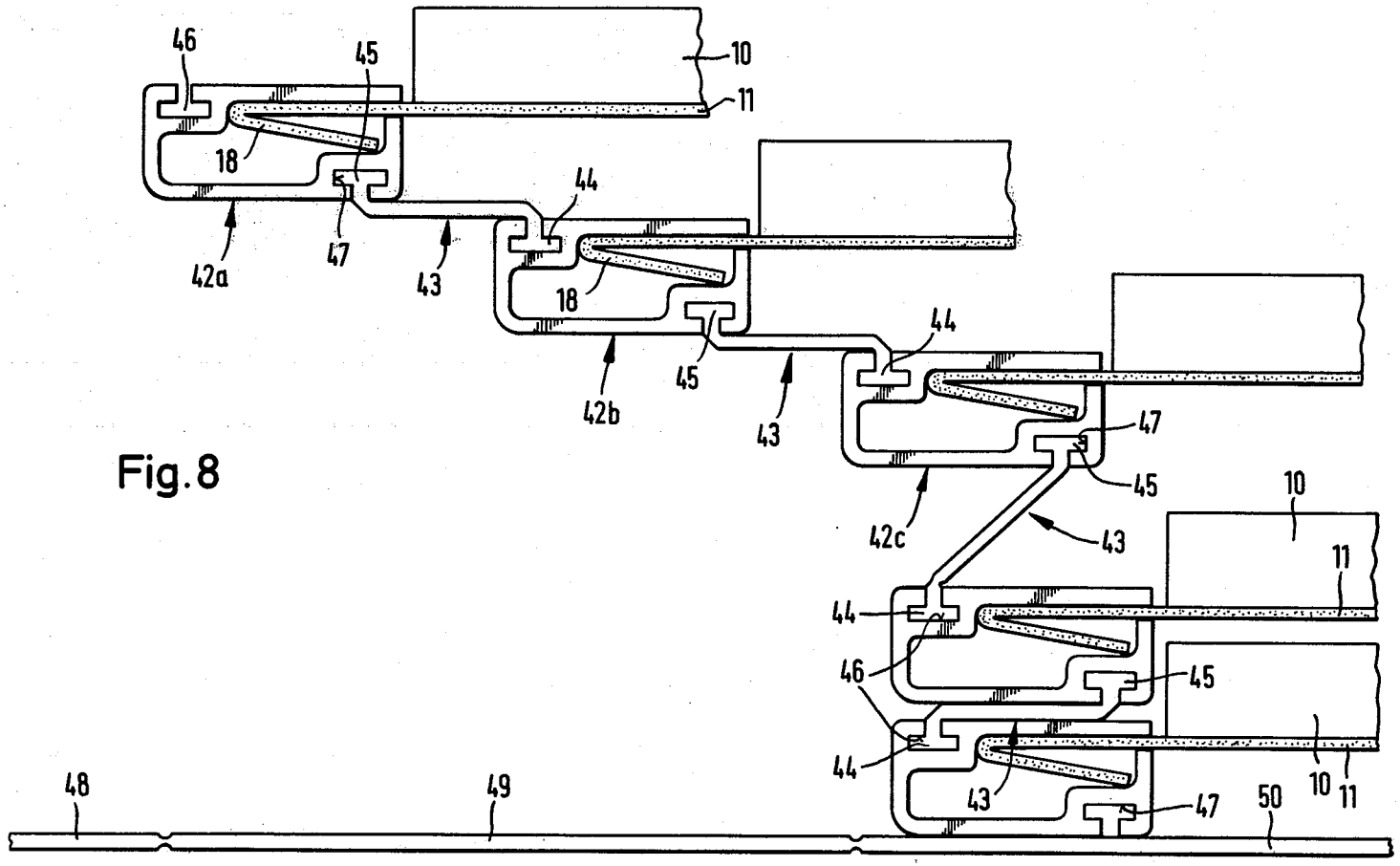
FIG. 8 is a view in diagrammatic side elevation of another embodiment of a pattern book with some of its pattern cards disposed in a part-overlapping relationship to one another.

In another variant of the retaining rails, shown in FIG. 8, such rails 42*a*, 42*b*, 42*c* and so on are interconnected by deformable plastics connecting strips 43 whose longitudinal edges have thickened parts in the form of transverse latching elements 44, 45 engaging positively in matching grooves 46, 47 in the facing sides of adjacent rails.

The unit formed by the rails 12*a*, 12*b* etc. or 27*a*, 27*b* etc. or 42*a*, 42*b* etc. together with the pattern cards 11 has an outer cover resembling a book and taking the form of a hinging top cover 48, spine 49 and bottom cover 50, the complete unit being connected to the bottom cover or base 50. The latter connection is provided by means of a connecting rail 51 of appropriate construction and disposed below the unit formed by the retaining rails. The connecting rail 51 is connected at one end to the next retaining rail, in the manner hereinbefore described, and at its other end by way of a member 52 of resilient material, more particularly plastics, to the member 50 by way of a fixing point 53 remote from the connecting rail 51. The member 52 ensures that there is sufficient clearance for the movement of the retaining rails and of the connecting rail 51 when the cards 11 are leafed through.

Figure 9:
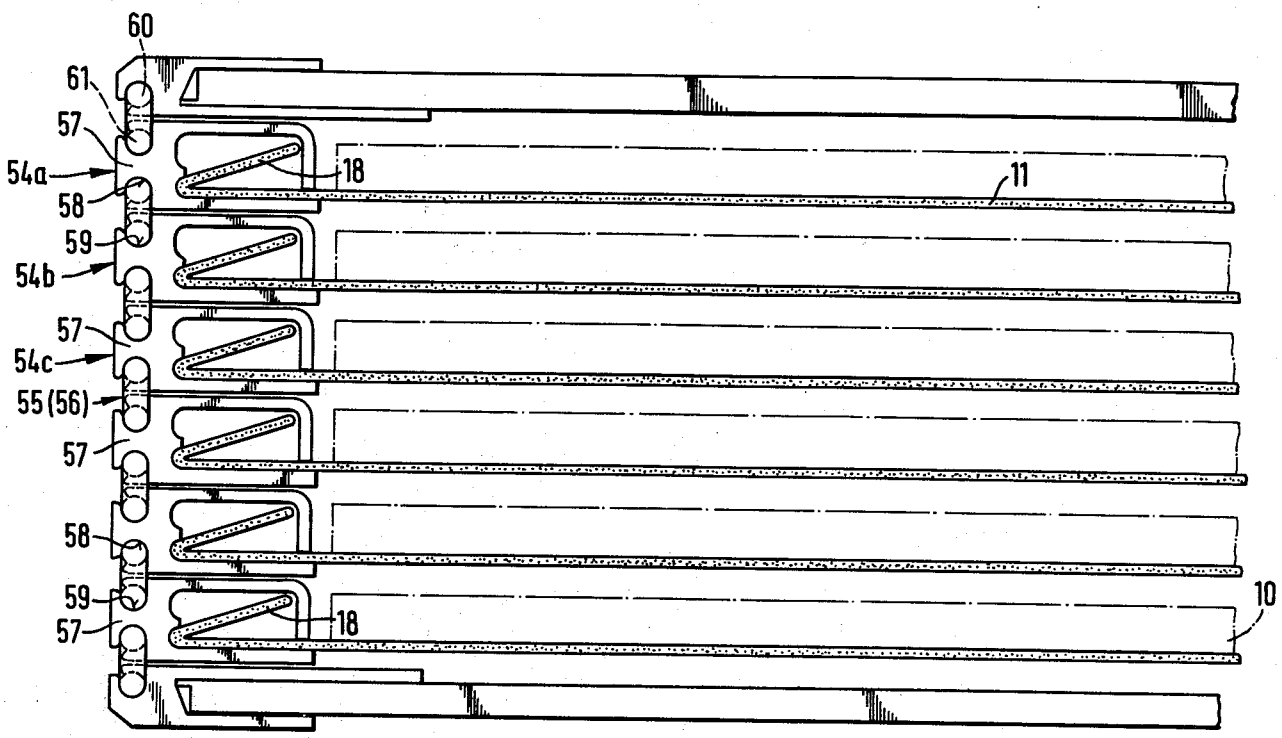
FIG. 9 is a view in diagrammatic side elevation and in the closed state of another variant of a pattern book in which the pattern cards can merely pivot like the pages of a book.
Figure 10:
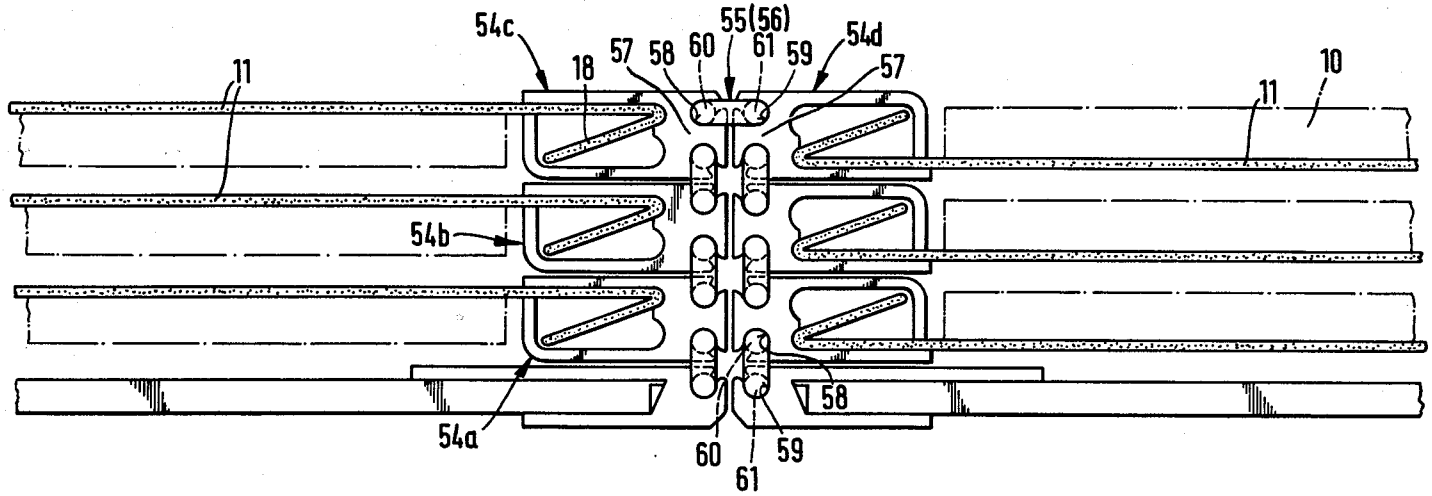
FIG. 10 shows the pattern book of FIG. 9 open.

FIGS. 9 and 10 show another embodiment of a pattern book, in this case of the kind in which the discrete pattern cards or retaining rails 54*a*, 54*b*, 54*c* are merely pivotable like the pages of a book and cannot be moved in translation. The rails 54*a* and so on are, as in the previous embodiments, interconnected by means of U-members 55, 56 which can be devised similarly to the members 28, 29.

Two recessed parts in the form of open or closed passages 58, 59 and disposed one above another are provided merely near the rear wall 57 of the retaining rails and are near the rear boundary surface and near the back top and bottom corners of the retaining rails. The same are so interconnected that the U-members 55, 66 have their arms 60, 61 engaged in the immediately adjacent passages 58, 59 of rails disposed one above another. As can be gathered from FIG. 10, the rails can then be turned like the pages of a book.

I claim:

1. A hinged binder assembly for a plurality of stacked planar cards on which rug samples or the like may be mounted, and including a plurality of generally rectangular, hollow rail members individually receiving and holding one end of a sample card, with said rail members lying adjacent to and one above the other when the binder assembly is in a closed position, comprising:

(a) cylindrical lateral channels defined in and extending through respective front and rear walls of each rail member, (b) a plurality of U-shaped stirrups each including a pair of parallel cylindrical arms and a connecting web, and (c) a pair of stirrups being connectingly disposed on opposite sides of each adjacent set of upper and lower rail members with one arm of each stirrup rotatably engaged in a rear wall channel of a lower rail member and the other arm rotatably engaged in a front wall channel of an upper rail member, with the web of each stirrup thus lying at an inclined angle between adjacent rail members, (d) whereby the sample bearing cards may be turned over one at a time in the manner of book pages, or pulled out in a translational manner into a partially overlapping stepped configuration wherein portions of all samples are exposed for viewing.

2. An assembly according to claim 1, wherein the channels are accessible through slots in the front and rear walls, whereby the stirrup arms may be snap-engaged in the channels.

3. An assembly according to claim 1, wherein the rail members are movable into the "stepped" position by displacement along a circular arc of approximately 180°.

4. An assembly according to claim 3, further comprising means for preventing the stirrups from moving axially relative to the rail members.

5. An assembly according to claim 4, wherein the stirrups are anchored in the rail members by thickened collars on the arms.

6. An assembly according to claim 5 wherein the rail member channels have transverse grooves in which the thickened collars on the arms positively engage.

7. An assembly according to claim 6, wherein the arms of the stirrups narrow towards their ends to terminate in pointed ends.

8. An assembly according to claim 1, wherein the outside surfaces of the front and rear walls of the rail members are in the shape of circular arcs.

9. An assembly according to claim 1, wherein a connecting rail is disposed below the lowest rail member, rests on a bottom book cover, and is releasably secured thereto by a resilient tongue.

* * * * *